US007401598B2

(12) United States Patent
Ochiai

(10) Patent No.: US 7,401,598 B2
(45) Date of Patent: Jul. 22, 2008

(54) OUTBOARD MOTOR WITH FORWARD AIR INTAKE AND AIR-COOLED FUEL PUMP

(75) Inventor: Katsumi Ochiai, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 43 days.

(21) Appl. No.: 11/228,558

(22) Filed: Sep. 16, 2005

(65) Prior Publication Data

US 2006/0107931 A1 May 25, 2006

(30) Foreign Application Priority Data

Sep. 16, 2004 (JP) ..... 2004-270027

(51) Int. Cl.
*F02M 37/20* (2006.01)
*F01N 7/00* (2006.01)

(52) U.S. Cl. ..... 123/516; 440/88 A; 440/88 F

(58) Field of Classification Search ..... 123/516, 123/509; 440/88 A, 88 F
See application file for complete search history.

(56) References Cited

U.S. PATENT DOCUMENTS 5,445,547 A * 8/1995 Furukawa ..... 440/77
5,797,378 A 8/1998 Kato
5,899,778 A * 5/1999 Hiraoka et al. ..... 440/88 R
5,941,205 A * 8/1999 Hiraoka et al. ..... 123/184.35
6,413,131 B1 * 7/2002 Phillips et al. ..... 440/88 R
6,561,773 B1 * 5/2003 Fischer ..... 417/366
6,645,021 B1 * 11/2003 Kawai et al. ..... 440/76

FOREIGN PATENT DOCUMENTS

JP 09-144617 6/1997

* cited by examiner

*Primary Examiner*—Stephen K. Cronin
*Assistant Examiner*—J.Page Hufty
(74) *Attorney, Agent, or Firm*—Knobbe, Martens, Olson & Bear, LLP

(57) ABSTRACT

An outboard motor can comprise a cowling for covering an engine, a high pressure fuel supply system, and a low pressure fuel supply system. The high pressure fuel supply system can have a vapor separator tank and a high pressure fuel pump. The low pressure fuel supply system can have a low pressure fuel pump. A heat insulating chamber, defined from a space for accommodating the engine, can be formed within the cowling. The heat insulating chamber houses the low pressure fuel pump and the fuel filter.

14 Claims, 5 Drawing Sheets

OUTBOARD MOTOR WITH FORWARD AIR INTAKE AND AIR-COOLED FUEL PUMP

PRIORITY INFORMATION

This application is based on and claims priority under 35 U.S.C. §119 to Japanese Patent Application No. 2004-270027, filed on Sep. 16, 2001, the entire contents of which is hereby expressly incorporated by reference herein.

BACKGROUND OF THE INVENTIONS

1. Field of the Inventions

The present inventions relate to an outboard motor equipped with a low pressure fuel pump disposed in the internal space of a cowling for covering the engine of the outboard motor.

2. Description of the Related Art

Some of the known outboard motor designs include a vapor separator tank disposed within the upper cowling of the outboard motor. For example, Japanese Patent Document JP-A-Hei09-144617, in at least FIG. 2 thereof, discloses such an outboard motor. In this outboard motor, both a vapor separator tank and a low pressure fuel pump are positioned on a side of and adjacent to the engine, within the cowling.

The vapor separator tank accumulates fuel to be supplied to the engine, and also has a high pressure fuel pump therein. A high pressure fuel supply conduit is connected to the vapor separator tank to supply the fuel discharged from the high pressure pump to fuel injectors. Also, a high pressure fuel return conduit is connected to the fuel injectors to return the surplus of the fuel to the vapor separator tank.

The low pressure fuel pump is used to supply the fuel to the vapor separator tank from the main fuel tank in the hull of the associated boat. The low pressure fuel pump is positioned on a side of and adjacent to the engine, and is mounted on the engine via a bracket. An upstream side low pressure fuel supply conduit is coupled with a fuel suction port of the low pressure fuel pump and extends to the main fuel tank in the cowling. A downstream side low pressure fuel supply conduit is coupled with a discharge port of the low pressure fuel pump and extends to the vapor separator tank.

A fuel filter is situated midway of the upstream side fuel supply conduit that extends within the cowling. A switching valve is placed at a fuel inlet port of the vapor separator tank, to which the downstream side low pressure fuel supply conduit is connected, to be opened or closed by a float floating in this tank. The switching valve is closed when a surface of the fuel in the vapor separator tank reaches the preset maximum level, and it is opened when the surface of the fuel goes down to a level lower than the maximum level.

In such an outboard motor, the low pressure fuel pump supplies the fuel in the main fuel tank in the hull to the vapor separator tank in the outboard motor. The high pressure fuel pump supplies the fuel in the vapor separator tank to the fuel injectors.

SUMMARY OF THE INVENTIONS

An aspect of at least one of the embodiments disclosed herein includes the realization that insulation can aid in preventing fuel interruption problems caused by heat from the engine vaporizing and pressurizing fuel in the fuel supply system. For example, occasionally, before starting a conventional outboard motor described above, an operator needs to supply fuel to the vapor separator tank from the main fuel tank using the manually operated primer pump. A so-called "dead soak," is when the operator stops the engine immediately after a full speed running of an associated watercraft and then restarts the engine a preset time later. When the engine is stopped, a temperature within the cowling increases by the heat of the engine under the stopped condition of the watercraft so that the fuel in each fuel passage of the respective conduits vaporizes. In particular, if a fuel that has a high lead vapor pressure is used, or the outboard motor is used under circumstances such that an air temperature or a water temperature is relatively high, an amount of the fuel that vaporizes can be larger.

When the fuel in the fuel passages vaporizes as discussed above, the vapor pushes the liquid fuel back to the main fuel tank. Consequently, the fuel passages can be nearly or completely depleted of liquid fuel. If the engine is started under the condition that only a nominal amount of the liquid fuel is in the fuel passages in the low pressure fuel supply system, all of the fuel in the vapor separator tank may be consumed before the fuel in the main fuel tank is supplied to the vapor separator tank by the low pressure fuel pump. As a result, the engine can stall.

Thus, in the conventional fuel supply device, if the performs a "dead soak", the operator needs to supply the fuel to the low pressure fuel supply system using the manually operated primer pump prior to restarting of the engine as described above. This operation of the primer pump can be a burden for the operator because the operator repeatedly grasps and releases a pressurizing portion made of a rubber material by hand.

In addition, the primer pump is used when, other than the dead soak type operation, the main fuel tank is replenished with another amount of fuel after the engine completely consumed the fuel in the main fuel tank. This operation of the primer pump can be a similar burden to the operator.

Thus, in accordance with an embodiment an outboard motor can comprise, an engine, a cowling defining a space accommodating the engine within the outboard motor, a high pressure fuel supply system having a vapor separator tank and a high pressure fuel pump, a low pressure fuel supply system having a low pressure fuel pump, and a heat insulating chamber. The high and low pressure fuel supply systems are disposed within the cowling, wherein the heat insulating chamber is defined in the space accommodating the engine, within the cowling, and wherein the heat insulating chamber houses parts of the low pressure fuel supply system.

In accordance with another embodiment, an outboard motor can comprise, an engine, a cowling defining a space accommodating the engine within the outboard motor, a high pressure fuel supply system having a vapor separator tank and a high pressure fuel pump. A low pressure fuel supply system can have a low pressure fuel pump and means for insulating parts of the low pressure fuel supply system from heat from the engine.

BRIEF DESCRIPTION OF THE DRAWINGS

These and other features and advantages of the inventions will become more apparent upon reading the following detailed description and with reference to the accompanying drawings of embodiments that exemplify the inventions, in which.

DETAILED DESCRIPTION OF THE PREFERRED EMBODIMENT

Figure 1:
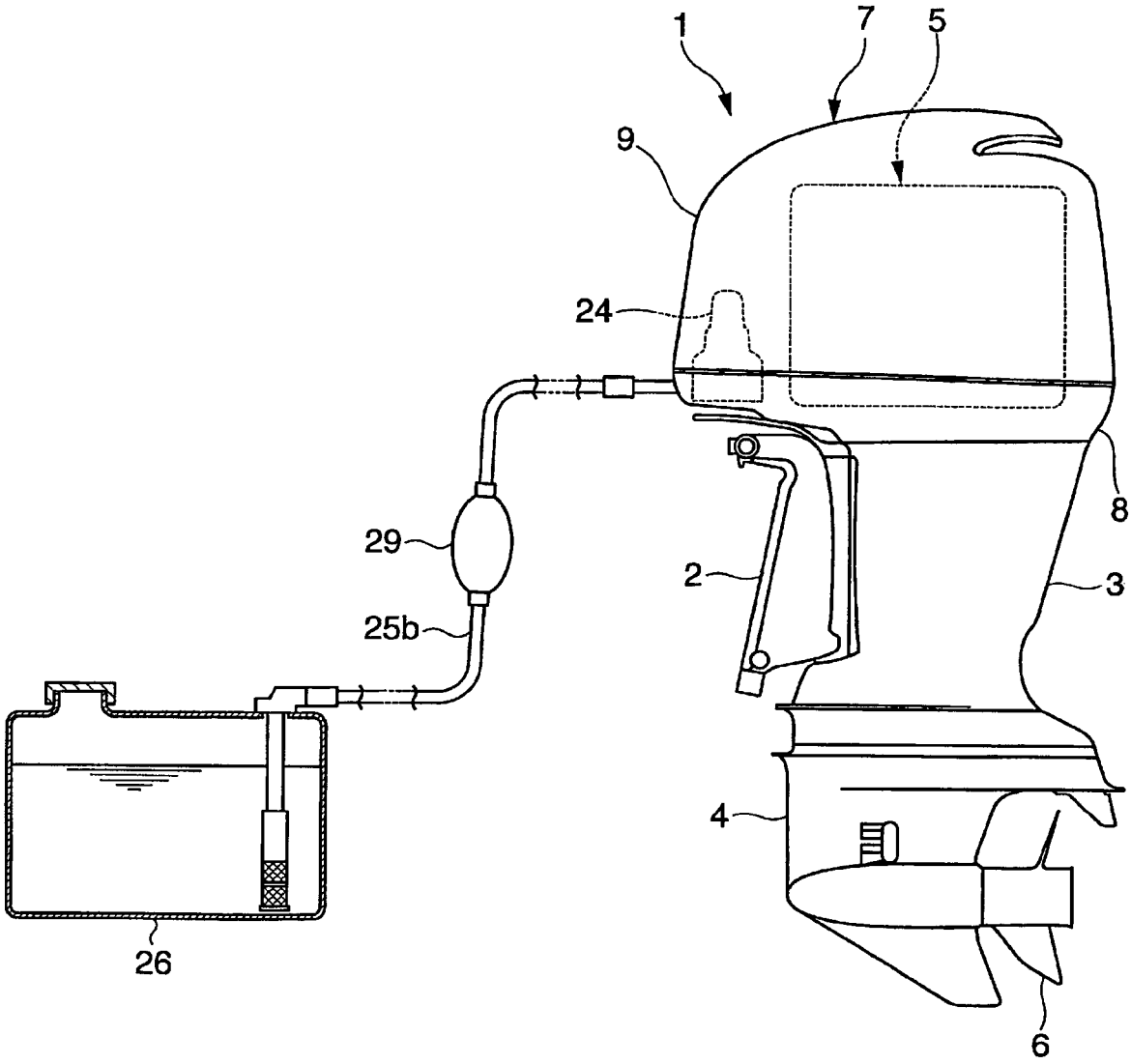
FIG. 1 is a schematic side elevational view of an outboard motor according to an embodiment.

Reference numeral 1 in these figures indicates the outboard motor in an embodiment. The inventions disclosed herein are disclosed in the context of outboard motors because these inventions have particular utility in this context. However, the inventions disclosed herein can also be used in other contexts, including other types of engines used to power other types of vehicles and other types of machines.

The outboard motor 1 can include a clamping bracket 2 to be mounted on a transom board of a hull which is not shown, an upper casing 3 and a lower casing 4 both supported by the clamping bracket 2, an engine 5 laid above the upper casing 3, a propeller 6 rotated by the power from the engine 5, and a cowling 7 that encloses the engine 5 and so forth. However, other configurations can also be used.

Figure 2:
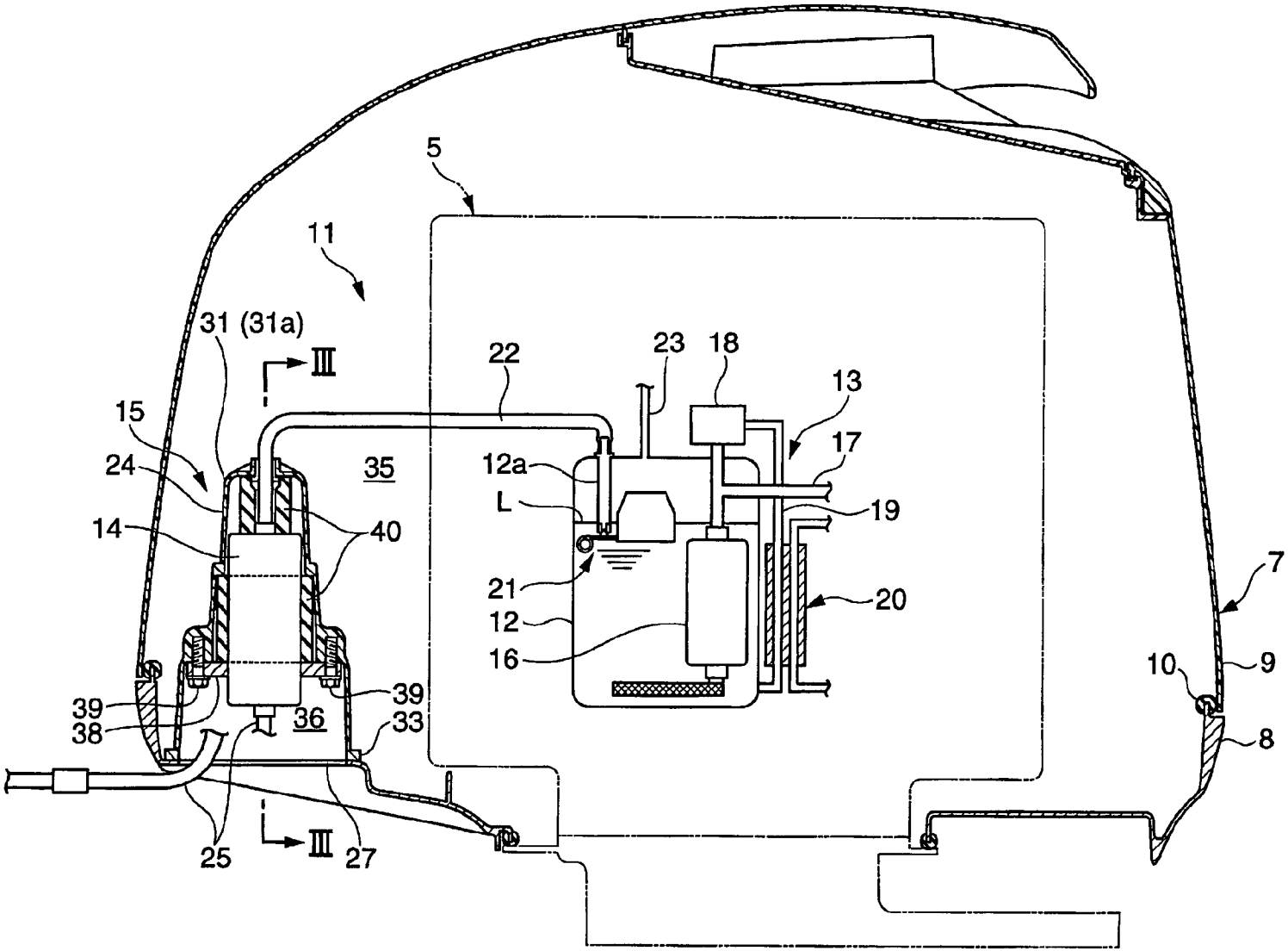
FIG. 2 is an enlarged cross sectional view of the powerhead of the outboard motor of FIG. 1, and shows a partial sectional and cutaway schematic view of a portion of a fuel supply system, a cowling, and a heat insulating chamber.

The cowling 7 can include a bottom cowling 8 in the form of a shallow tray that opens upwardly and is coupled with an upper portion of the upper casing 3, and a top cowling 9 that closes the opening defined at the upper end of the bottom cowling 8. As shown in FIG. 2, a seal member 10 can be used to form a substantially water-tight seal between the bottom cowling 8 and the top cowling 9. The bottom cowling 8 can be made of an aluminum alloy, and the top cowling 9 can be made of a synthetic resin, although other materials can also be used.

Figure 3:
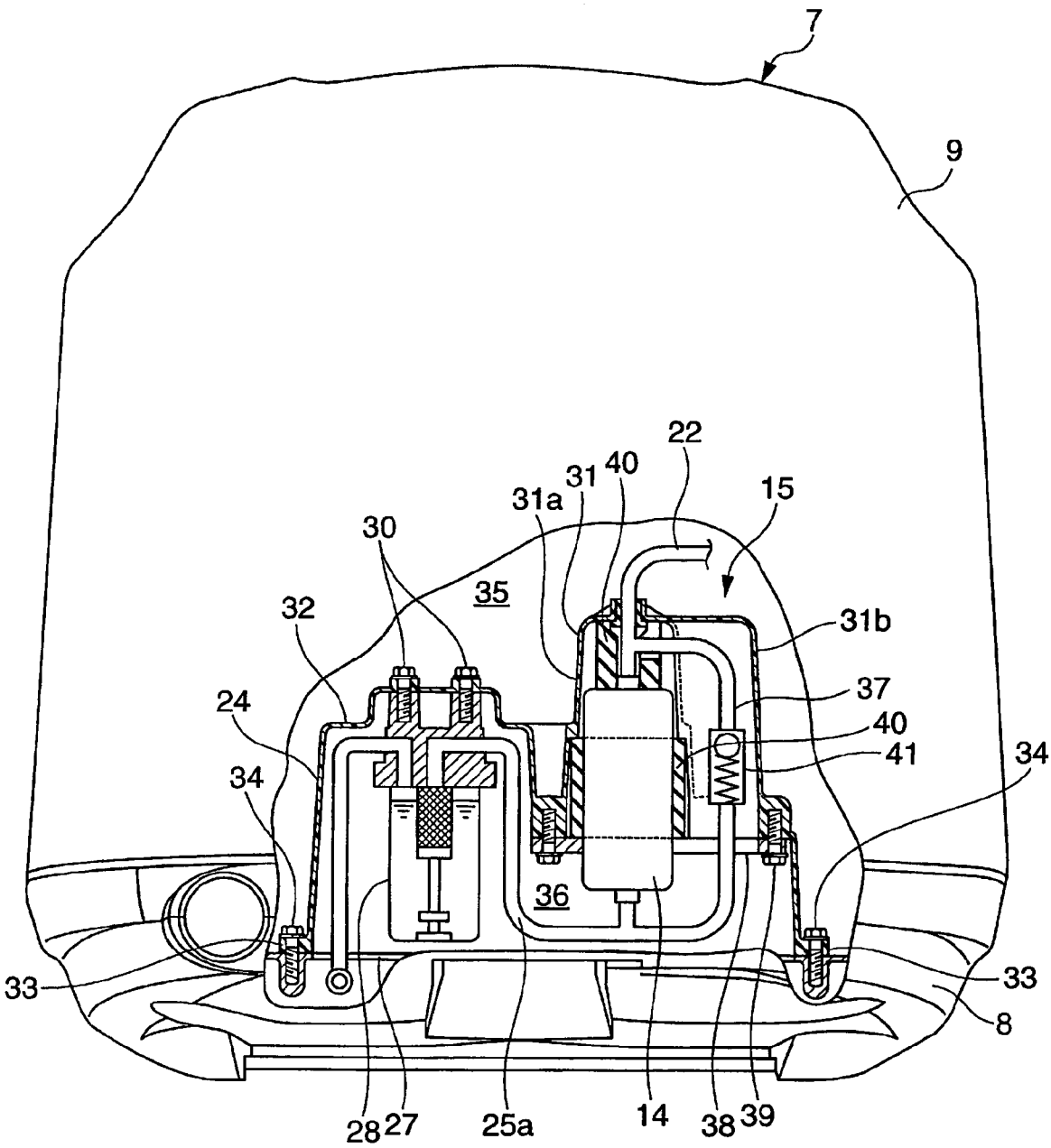
FIG. 3 is a partial cut-away, sectional and front elevational view of the powerhead, with certain internal components, including parts of the fuel supply system, shown partially in section (taken along the line III-III of FIG. 2).

The engine 5 can have a fuel supply device 11 including fuel injectors (not shown). As shown in FIGS. 2 and 3, the fuel supply device 11 can include a high pressure fuel supply system 13 and a low pressure fuel supply system 15. The high pressure fuel supply system 13 can have a vapor separator tank 12 which is further described below. The low pressure fuel supply system 15 can have a low pressure fuel pump 14 which is further described below.

The high pressure fuel supply system 13 can comprise the vapor separator tank 12 positioned on a side of the engine 5, a high pressure fuel pump 16 placed within the vapor separator tank 12, the fuel injectors (not shown) connected to the high pressure pump 16 through high pressure fuel supply conduits 17, a pressure regulator 18 for regulating the fuel pressure in the high pressure fuel supply conduits 17 and so forth. However, other configurations can also be considered a "fuel supply system." In some embodiments, a water-cooled fuel cooling unit 20 can be coupled with a portion of a fuel return conduit 19 connecting a downstream side of the pressure regulator 18 and an internal cavity of the vapor separator tank 12.

A float type switching valve 21 can be disposed in the cavity of the vapor separator 12 and configured to close and open a bottom end opening of a fuel inlet port pipe 12*a*. The switching valve 21 can be configured to close the opening when a liquid surface L in the vapor separator tank 12 is positioned at the highest level shown in FIG. 2. The switching valve 21 can also be configured to release the opening when the liquid surface L is lowered from the highest level.

The fuel inlet port pipe 12*a* can be connected to a low pressure fuel pump 14, which is further described below, through a downstream side low pressure fuel supply conduit 22. A pipe 23 can be coupled with a top end of the vapor separator tank 12 to guide vapor (fuel gas) developed in the cavity of the vapor separator tank 12 to an intake passage of the engine.

The high pressure fuel pump 16 draws fuel from the cavity of the vapor separator tank 12 and discharges it to the high pressure fuel supply conduits 17. The components of the high pressure fuel supply system 13, including the high pressure fuel pump 16, can be positioned on a side of and adjacent to the engine 5 within the cowling 7.

As shown in FIGS. 2 and 3, the low pressure fuel pump 14 can be accommodated in a heat insulating case 24, which is further described below, and can be supported with the cowling 7 through the heat insulating case 24. The low pressure fuel pump 14 and the heat insulating case 24 can be positioned within the cowling 7 at the forward end of the outboard motor, although other arrangements can also be used.

The low pressure fuel pump 14 can incorporate a drive motor (not shown) therein, and can be mounted on the heat insulating case 24. In some embodiments, an axis of a drive shaft positioned in the drive motor extends generally vertically.

A top end of the low pressure fuel pump 14 can have a fuel discharge port (not shown). The downstream side low pressure supply conduit 22 can be coupled with the fuel discharge port. On the other hand, a bottom end of the low pressure fuel pump 14 can have a fuel suction port (not shown). An upstream side low pressure fuel supply conduit 25, which is further described below, can be coupled with the fuel suction port.

The upstream side low pressure fuel supply conduit 25 can be designed to connect the fuel suction port of the low pressure fuel pump 14 to a fuel discharge port of the main fuel tank 26 on the hull side shown in FIG. 1. The upstream side low pressure fuel supply conduit 25 can extend from the bottom end of the low pressure fuel pump 14 to the right of the outboard motor 1, and can further extend forward from the inside of the outboard motor 1 to the hull through an opening 27 formed on the bottom cowling 8. The opening 27 can be formed on the bottom cowling 8 at the forward end and lateral center of the outboard motor.

As shown in FIG. 3, a portion 25*a* of the upstream side low pressure fuel supply conduit 25, which can extend generally horizontally from the bottom end of the low pressure fuel pump 14 to the right of the outboard motor 1, can have a fuel filter 28. As shown in FIG. 1, another portion 25*b* of the upstream side low pressure fuel supply conduit 25, which can extend to the main fuel tank 26 in the hull, can have a manually operated fuel pump 29.

As shown in FIG. 3, the fuel filter 28 can be secured to the heat insulating case 24 (further described below) with fixing bolts 30. The fuel filter 28 can be supported with the bottom cowling 8 through the heat insulating case 24.

The heat insulating case 24 can be made of a synthetic resin and formed into a box lid shape that opens downwardly. As shown in FIG. 3, the upper part of the heat insulating case 24, in some embodiments, can be formed with a left projection 31 and a right projection 32. The left and right projections 31 and 32 can have an internal space large enough to accommodate the low pressure fuel pump 14 and the fuel filter 28, respectively.

The bottom end of the heat insulating case 24 can be formed into a shape that can cover, from above, the opening 27 which can be provided at the forward end of the bottom cowling 8. As shown in FIG. 2, a longitudinal length of the opening 27 can be greater than a longitudinal length of the low pressure fuel pump 14, and a horizontal width of the opening 27 can be greater than total width of the low pressure fuel pump 14 and fuel filter 28 that are aligned horizontally, as shown in FIG. 3.

The bottom end of the heat insulating case 24 can be provided with a flange 33 formed along the opening 27, as shown in FIG. 3. The heat insulating case 24 can be secured to the bottom cowling 8 with fixing bolts 34 inserted through the flanges 33 from above, although other fastening means can also be used.

The flange 33 can extend along the entire periphery of the opening 27 for example, in some embodiments, the heat insulating case 24, which can be secured to the bottom cowling 8, can provide a heat insulating chamber 36 within the cowling, the heat insulating chamber being defined from a space 35 for accommodating the engine in the cowling 7. The heat insulating chamber 36 can be exposed to the atmosphere through the opening 27.

The left projection 31 of the heat insulating case 24, which as noted above can be designed to accommodate the low pressure fuel pump 14, can also include a cylindrical portion 31*a* and a horizontal bulge 31*b*. The cylindrical portion 31*a* can be configured to accommodate the low pressure fuel pump 14. The horizontal bulge 31*b* can be configured to accommodate a bypass pipe 37 (see FIG. 3) formed around the low pressure fuel pump 14.

The lower end of the low pressure fuel pump 14, accommodated in the left projection 31, can be provided with a generally horizontal plate 38. The low pressure fuel pump 14 can be mounted to the heat insulating case 24 through the plate 38, although other configurations can also be used. The plate 38 can be large enough to close a lower opening of the left projection 31, and can be secured to the opening with fixing bolts 39 from below.

The downstream side low pressure fuel supply conduit 22 connected to the top end of the low pressure fuel pump 14 can protrude through a top wall of the cylindrical portion 31*a* to lead to the outside of the heat insulating case 24. A rubber cushion 40 can be interposed respectively between a peripheral wall of the cylindrical portion 31*a* and an outer peripheral wall of the low pressure fuel pump 14, and between the top wall of the cylindrical portion 31*a* and a top face of the low pressure fuel pump 14. The bypass pipe 37 accommodated in the horizontal bulge 31*b* of the left projection 31, can be provided with a relief valve 41.

The right projection 32 of the heat insulating case 24 can be formed into a cylindrical shape that can cover the fuel filter 28 from above. The fuel filter 28 can be secured to the underside of the top wall of the right projection 32 with fixing bolts 30. The fixing bolts 30 protrude through the top wall from above to be fitted into the fuel filter 28.

The outboard motor 1 constructed as such can have the heat insulating chamber 36 within the cowling 7 that covers the engine 5. The heat insulating chamber 36 can be defined in the space 35 for accommodating the engine 5, and can house the parts of the low pressure fuel supply system 15, such as the low pressure fuel pump 14, the fuel filter 28 and the horizontally extending portion 25*a* of the upstream side low pressure fuel supply conduit 25, and/or other components. Thus, the heat insulating case 24, which defines the heat insulating chamber 36, can protect the parts of the low pressure fuel supply system 15 from heat from the engine 5 or radiant heat.

Thus, even when the engine 5 of the outboard motor 1 is stopped under high temperature conditions, the parts of the low pressure fuel supply system 15 are protected from heat from the engine 5. This allows the liquid fuel in the low pressure fuel supply system 15 to remain in a liquid state when the engine is stopped. Consequently, in the outboard motor 1, the fuel can be supplied to the vapor separator tank 12 with the low pressure fuel pump 14 immediately after the engine 5 is restarted, thereby better accommodating quick restarts of the engine 5.

In the outboard motor 1 according to the embodiments of FIGS. 1-3, the opening 27, through which the heat insulating chamber 36 is exposed to the atmosphere, can be formed on the bottom surface of the bottom cowling 8. This allows air heated in the heat insulating chamber 36 to be discharged out through the opening 27. This ensures air ventilation in the heat insulating chamber 36, so that the outboard motor 1 can keep the temperature of the low pressure fuel supply system 15 lower.

Figure 4:
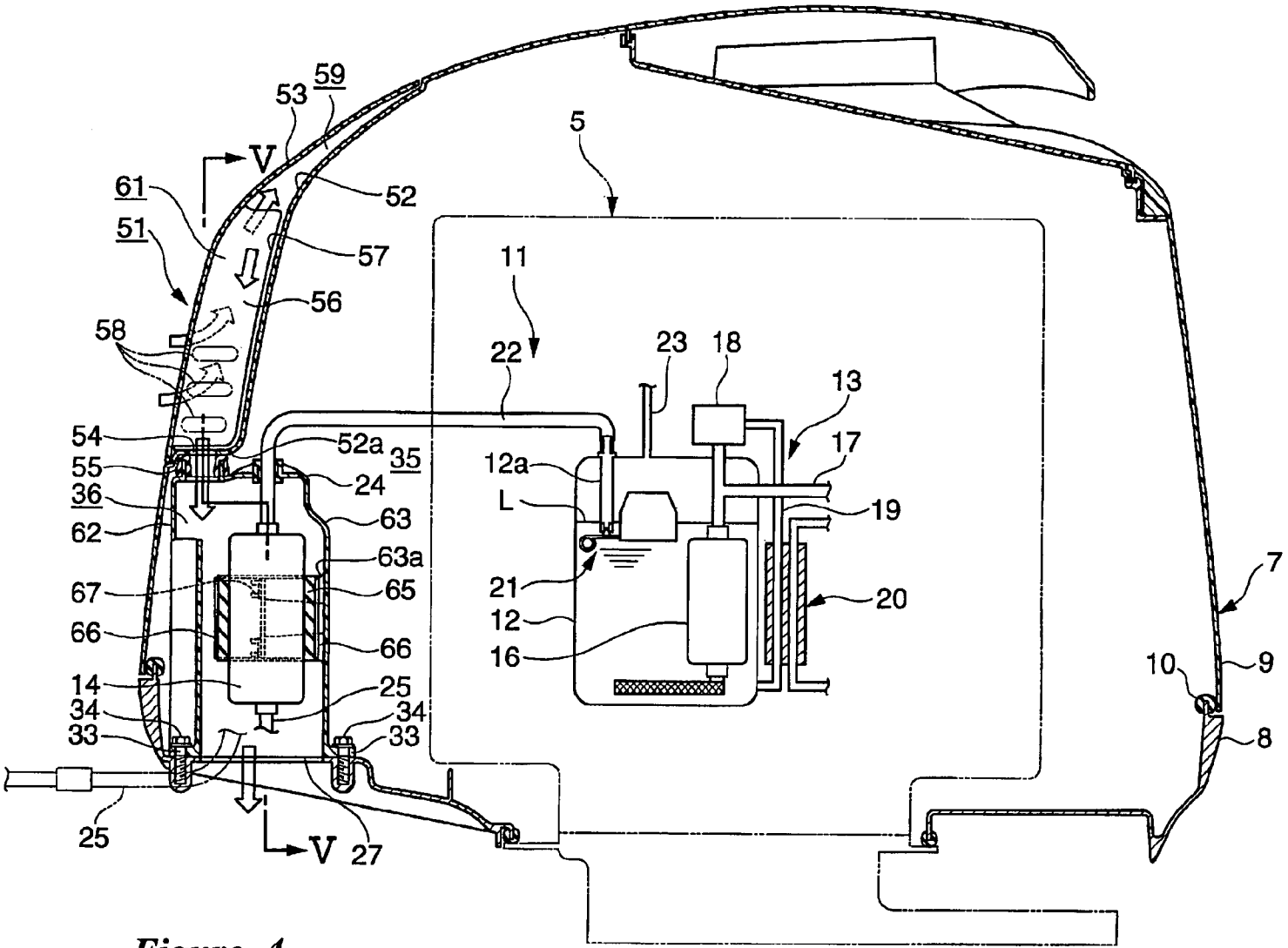
FIG. 4 is an enlarged cross sectional view of a modification of the powerhead of the outboard motor of FIG. 1, and shows a partial sectional and cutaway schematic view of a portion of a fuel supply system, a cowling, and a heat insulating chamber.
Figure 5:
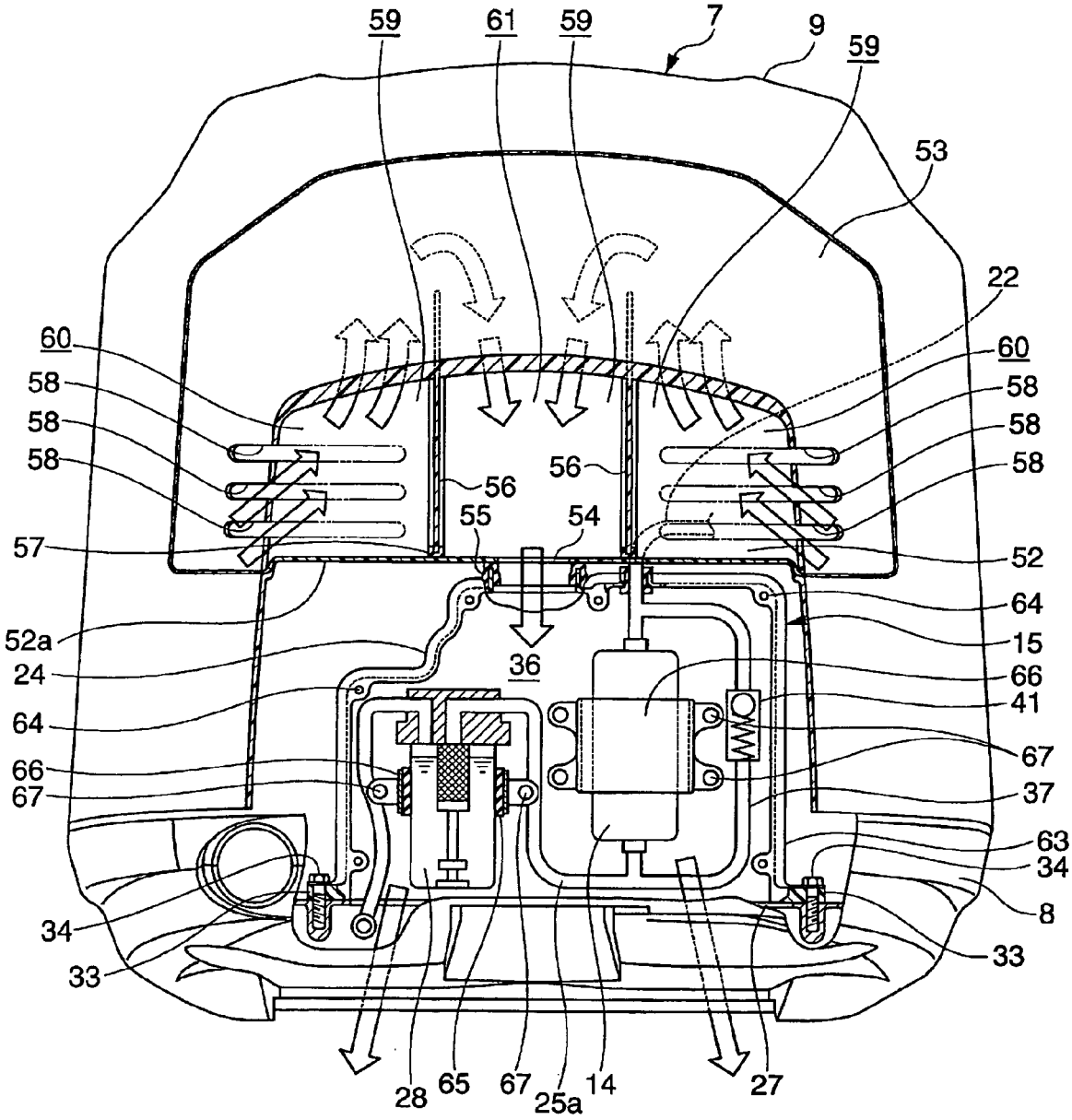
FIG. 5 is a partial cut-away and front elevational view of the powerhead, taken along the line V-V in FIG. 4, with certain internal components, including parts of the fuel supply system, shown partially in section.

FIGS. 4 and 5 illustrate a modification of the outboard motor 1 of FIGS. 1-3. In these embodiments, the forward end of a cowling 7 can be formed with a ventilation duct, as shown in FIGS. 4 and 5.

In the drawings, components identical or equivalent to those described in relation to the embodiments of FIGS. 1 to 3 are denoted by the same reference numerals, and their detailed descriptions are not repeated.

An outboard motor 1 shown in FIGS. 4 and 5 can have a ventilation duct 51 provided at the forward end of the cowling 7. The ventilation duct 51 can include a recess 52 and a cover 53. The recess 52 can have a depression to the rear on the front face of the top cowling 9. The cover 53 can be mounted to the top cowling 9 from the front so as to close the forward opening of the recess 52.

The recess 52 can be formed by recessing the upper and lateral center part of the front face of the top cowling 9 to the rear. The recess 52 can have a horizontal wall 52*a* on its bottom side. At the lateral center of the horizontal wall 52*a*, a hole 54 passing through the horizontal wall 52*a* can be formed. A cylindrical seal member 55 can be provided at the top end of the heat insulating case 24 to connect the hole 54 to the top end of the heat insulating chamber 36.

As shown in FIG. 5, the cover 53 can have the same shape as the opening of the recess 52 in front view. Two partitions 56, 56, together with the cover 53, can be formed into a single unit. The two partitions 56, 56 can protrude rearwardly from the inner face of the cover 53.

The partitions 56 extend generally vertically from the bottom to the top of the cover 53 with a given lateral distance therebetween. A protruding end (rear end) of each partition 56 can contact the front face of the recess 52 via a seal member 57 as shown in FIG. 4.

Plural air vents 58 can be formed on the left side of the outboard motor or leftward from the partition 56 and on the right side of the outboard motor or rightward from the partition 56. The air vents 58 can pass through the cover 53 in the fore to aft direction. Also, the air vents 58 can be oriented forwardly of the outboard motor 1. Thus, head wind generated by forward movement of the outboard motor 1 enters the air vents 58, 53 provided on the cover.

Mounting the cover 53 including the partitions 56, 56 to the top cowling 9 provides an inverse-U-shape air passage 59 for each partition 56 between the cover 53 and the recess 52 in the cowling 7. More specifically, the air passages 59 include outer passages 60 positioned on opposite sides and an inner passage 61 positioned between the outer passages 60.

The outer passages 60 extend outward of the partitions 56. (on the left side of the outboard motor or leftward from the partition 56 and on the right side of the outboard motor or rightward from the partition 56). The lower end of each outer passage communicates with the atmosphere forward of the outboard motor 1 through the air vents 58.

The inner passage 61 extends between the two partitions 56. The upper end of the inner passage 61 communicates with the outer passages 60 above the partitions 56, while the lower end thereof can be connected to the heat insulating chamber 36 through the hole 54 and the cylindrical seal member 55.

The air passages 59 lead head wind, which is caused by forward movement of the outboard motor 1 and introduced through the air vents 58, to the heat insulating chamber 36. The direction of this air flow is shown by the arrows in FIGS. 4 and 5. The upper area of the outer passages and the upper area of the inner passage can be considered to form an upper extending portion.

The heat insulating case 24, in some embodiments, can be formed such that it is divided into two in the fore-to-aft direction as shown FIG. 4; a front half 62 and rear half 63, which is forward and rearward of the outboard motor. Both the front half 62 and the rear half 63 can be connected to each other with connecting bolts. (not shown).

Reference numeral 64 in FIG. 5 denotes holes through which the connecting bolts can be inserted. In some embodiments, as shown in FIG. 5, a fuel pump 14 and a fuel filter 28 can be mounted to the rear half 63 of the heat insulating case 24.

These parts of the low pressure fuel supply system 15, and/or other parts, can be mounted to the rear half 63 by fitting them into a cylindrical cushion rubber 65 and securing two bands 66, 66 of semicircular cross-section, which tightly fasten the cushion rubber 65 from the front and the rear, to a mounting seat 63*a* of the rear half 63 with fixing bolts 67. The mounting seat 63*a* can be formed such that it can have the low pressure fuel pump 14 and the fuel filter 28 mounted thereto from the front of the outboard motor.

The heat insulating chamber 36 of the outboard motor 1 according to the second embodiment is exposed to the atmosphere through the opening 27 of the bottom cowling 8 and the air passages 59 of the ventilation duct 51. Thus, in the outboard motor 1, even when the engine 5 is stopped under high-temperature conditions, and the temperature in the heat insulating chamber 36 increases as the temperature in the heat insulating case 24 increases, air that passes through the opening 27 at the bottom surface of the bottom cowling 8 and through the interior of the ventilation duct 51 can ensure ventilation in the heat insulating chamber 36. Head wind, caused by forward movement of the outboard motor 1, flows through the ventilation duct 51 into the heat insulating chamber 36 according to the second embodiment.

Thus, the outboard motor 1 according to these embodiments can prevent high-temperature air from stagnating in the heat insulating chamber 36. The outboard motor 1 can also cool the parts of the low pressure fuel supply system 15, such as the low pressure fuel pump 14 and the fuel filter 28, using the head wind after the engine is restarted to start running of the watercraft.

What is claimed is:

1. An outboard motor comprising, an engine, a cowling defining a space accommodating the engine within the outboard motor, the cowling comprising a lower cowling defining an upper opening and an upper cowling, the upper cowling configured to be detachable from the upper opening of the lower cowling, a high pressure fuel supply system having a vapor separator tank and a high pressure fuel pump, a low pressure fuel supply system having a low pressure fuel pump disposed apart from the engine and forward from the engine, and a heat insulating chamber casing, wherein the high and low pressure fuel supply systems are disposed within the cowling, wherein the heat insulating chamber casing is defined in the space accommodating the engine, within the cowling, the lower cowling supporting the low pressure fuel pump through the heat insulating chamber casing, and wherein the heat insulating chamber casing houses parts of the low pressure fuel supply system.

2. The outboard motor according to claim 1, wherein an opening, through which the heat insulating chamber casing is exposed to the atmosphere, is formed on a bottom of the cowling.

3. The outboard motor according to claim 2, wherein the heat insulating chamber casing is provided at the forward part of the cowling, on which is provided a ventilation duct, the ventilation duct being formed with an air passage that extends from an air vent with its opening oriented toward the front face of the cowling to the heat insulating chamber casing.

4. The outboard motor according to claim 3, wherein an upper extending portion that is positioned above the air vent, extends midway of the air passage of the ventilation duct.

5. An outboard motor comprising, an engine, a cowling defining a space accommodating the engine within the outboard motor, the cowling comprising a lower cowling defining an upper opening and an upper cowling detachably connectable to the upper opening, a high pressure fuel supply system having a vapor separator tank and a high pressure fuel pump, a low pressure fuel supply system having a low pressure fuel pump disposed apart from the engine and forward from the engine, the low pressure fuel pump being disposed in a heat insulating casing, and means for supporting the low pressure fuel pump and heat insulating casing with the lower cowling.

6. The outboard motor according to claim 1, wherein the cowling includes a first intake air opening having a rearwardly facing opening and guiding air into the space housing the engine, and a second intake air opening having a forwardly facing opening and leading atmospheric air into the heat insulating chamber casing without entering the space housing the engine.

7. The outboard motor according to claim 6 additionally comprising an induction system configured to guide air from the space housing the engine into the engine for combustion therein.

8. The outboard motor according to claim 6 additionally comprising means for keeping air flowing into the heat insulating chamber casing separate from the air flowing into the space housing the engine.

9. An outboard motor comprising, an engine, a cowling comprising a lower cowling defining an upper opening and an upper cowling being detachable from the upper opening, the cowling, with the upper cowling attached to the upper opening, defining a space accommodating the engine within the outboard motor and having a first opening configured to guide atmospheric air in to the space, a high pressure fuel supply system having a vapor separator tank and a high pressure fuel pump, a low pressure fuel supply system having a low pressure fuel pump, and a heat insulating chamber casing, wherein the high and low pressure fuel supply systems are disposed within the cowling, wherein the heat insulating chamber is defined in the space accommodating the engine, within the cowling, wherein the heat insulating chamber houses at least the low pressure fuel pump, the cowling including a second opening configured to guide atmospheric air into the heat insulating chamber, and wherein the low pressure fuel pump is supported by the lower cowling with the heat insulating chamber casing.

10. The outboard motor according to claim 9 additionally comprising means for keeping air flowing into the heat insulating chamber separate from the air flowing into the space housing the engine.

11. The outboard motor according to claim 9, wherein the heat insulating chamber casing is securely mounted to the lower cowling and wherein the upper removeable portion of the cowling includes an aperture leading to the second opening, and wherein the outboard motor further includes a connector member removeably connecting the aperture with the heat insulating chamber casing.

12. An outboard motor comprising an engine, a cowling defining a space accommodating the engine within the outboard motor, the cowling comprising a lower cowling defining an upper opening and an upper cowling, the upper cowling configured to be detachable from the upper opening of the lower cowling, a high pressure fuel supply system having a vapor separator tank and a high pressure fuel pump, a low pressure fuel supply system having a low pressure fuel pump and a fuel filter disposed apart from the engine and forward from the engine, and a heat insulating chamber including a casing, wherein the high and low pressure fuel supply systems are disposed within the cowling, wherein the heat insulating chamber casing is defined in the space accommodating the engine, within the cowling, the lower cowling supporting the fuel filter through the heat insulating chamber casing, and wherein the heat insulating chamber casing houses parts of the low pressure fuel supply system.

13. An outboard motor comprising, an engine, a cowling defining a space accommodating the engine within the outboard motor, the cowling comprising a lower cowling defining an upper opening and an upper cowling detachably connectable to the upper opening, a high pressure fuel supply system having a vapor separator tank and a high pressure fuel pump, a low pressure fuel supply system having a fuel filter disposed apart from the engine and forward from the engine, the fuel filter being disposed in a heat insulating casing, and means for supporting the fuel filter and heat insulating casing with the lower cowling.

14. An outboard motor comprising an engine, a cowling comprising a lower cowling defining an upper opening and an upper cowling being detachable from the upper opening, the cowling, with the upper cowling attached to the upper opening, defining a space accommodating the engine within the outboard motor and having a first opening configured to guide atmospheric air in to the space, a high pressure fuel supply system having a vapor separator tank and a high pressure fuel pump, a low pressure fuel supply system having a fuel filter, and a heat insulating chamber casing, wherein the high and low pressure fuel supply systems are disposed within the cowling, wherein the heat insulating chamber is defined in the space accommodating the engine, within the cowling, wherein the heat insulating chamber houses at least the fuel filter, the cowling including a second opening configured to guide atmospheric air into the heat insulating chamber, and wherein the fuel filter is supported by the lower cowling with the heat insulating chamber casing.

* * * * *